US006843638B2

(12) United States Patent
Hidalgo et al.

(10) Patent No.: US 6,843,638 B2
(45) Date of Patent: Jan. 18, 2005

(54) VANE RADIAL MOUNTING APPARATUS

(75) Inventors: Mario A. Hidalgo, Phoenix, AZ (US); Adrian R. Allan, Chandler, AZ (US); Louis D. Cruse, Scottsdale, AZ (US)

(73) Assignee: Honeywell International Inc., Morristown, NJ (US)

( * ) Notice: Subject to any disclaimer, the term of this patent is extended or adjusted under 35 U.S.C. 154(b) by 106 days.

(21) Appl. No.: 10/316,542

(22) Filed: Dec. 10, 2002

(65) Prior Publication Data

US 2004/0109762 A1 Jun. 10, 2004

(51) Int. Cl.[7] ..... F01D 1/02
(52) U.S. Cl. ..... 415/209.3; 415/189
(58) Field of Search ..... 415/209.3, 160, 415/150, 156, 189, 119, 209.4, 209.2, 190, 135–137; 416/115, 190–191, 248

(56) References Cited

U.S. PATENT DOCUMENTS

| | | | | | |
|---|---|---|---|---|---|
| 2,812,159 | A | * | 11/1957 | Krebs | 415/119 |
| 3,070,352 | A | * | 12/1962 | Welsh | 416/191 |
| 4,119,389 | A | | 10/1978 | Gee | |
| 4,142,827 | A | | 3/1979 | Vinciguerra | |
| 4,255,086 | A | | 3/1981 | Roberts | |
| 4,363,600 | A | * | 12/1982 | Thebert | 415/156 |
| 4,395,195 | A | * | 7/1983 | De Cosmo et al. | 415/137 |
| 4,498,790 | A | * | 2/1985 | Fisher | 384/428 |
| 4,585,390 | A | * | 4/1986 | Pirtle et al. | 415/160 |
| 4,632,634 | A | | 12/1986 | Vinciguerra | |
| 4,792,277 | A | * | 12/1988 | Dittberner et al. | 415/160 |
| 4,834,613 | A | * | 5/1989 | Hansen et al. | 415/160 |
| 4,868,963 | A | | 9/1989 | Corsmeier | |
| 4,953,282 | A | | 9/1990 | Kelm | |
| 5,000,659 | A | * | 3/1991 | Catte et al. | 415/150 |
| 5,129,783 | A | | 7/1992 | Hayton | |
| 5,319,850 | A | | 6/1994 | Charbonnel et al. | |
| 5,328,327 | A | | 7/1994 | Naudet | |
| 5,399,069 | A | * | 3/1995 | Marey et al. | 415/209.3 |
| 5,421,703 | A | | 6/1995 | Payling | |
| 5,564,897 | A | | 10/1996 | Mansson | |
| 5,636,968 | A | * | 6/1997 | Audet et al. | 415/160 |
| 6,209,198 | B1 | | 4/2001 | Lammas et al. | |
| 6,409,472 | B1 | * | 6/2002 | McMahon et al. | 415/189 |

* cited by examiner

*Primary Examiner*—Edward K. Look
*Assistant Examiner*—J. M. McAleenan
(74) *Attorney, Agent, or Firm*—Robert Desmond, Esq.

(57) ABSTRACT

A variable geometry vane for use in a turbine engine. The vane can be radially mounted in a shroud ring while outside the turbine engine. The shroud and vane assembly can then be mounted to an engine hub without disassembly of the shroud, eliminating the need for a split ring shroud. Once located surrounding the hub, vanes are slid radially inward until a radially inward vane button engages a hole within the hub. Vanes are locked in place using clips slid into slots within the shroud. The clips are retained in place using an adjacent engine part bolted to the face of the shroud. Once in place within the engine, vanes are attached to a control arm for airflow adjustment.

41 Claims, 5 Drawing Sheets

VANE RADIAL MOUNTING APPARATUS

GOVERNMENT RIGHTS

The invention described herein was made in the performance of work under a government funded research and development program, JTAGGIII Contract Nos. F-3361598-C-2803 and DAAH-1098-C-0023 and is subject to the provisions of those contracts. The United States Government may have certain rights to this invention.

BACKGROUND OF THE INVENTION

In turbine engine construction it is common to use a stator to control and direct the flow of air within the compressor of the turbine engine. Radial vanes are commonly used to direct the flow. The vanes have a blade like shape and are typically attached at one end to an external housing and can be attached at the other end to an internal hub. The vanes generally have a radial orientation. Variable vanes include a control mechanism that rotates the vanes about their radial axis to control the direction and amount of airflow into downstream parts of the engine.

Variable geometry or static guide vanes, especially those having a locating button on the unshafted end, normally require a split ring housing, a separate locating ring, axial clearance grooves or a combination of these features in order to assemble the vane pattern. The requirement for these assembly methods in prior art devices is based on the fact that some form of axial motion is required to assemble the vanes into their final position caged inside the engine. All three methods have disadvantages. Using a split ring housing increases manufacturing costs because the two rings must be machined and maintained as a matched set. Making a separate locating ring requires making an additional, often flimsy part that can be difficult to hold in place and has holes with close tolerances making it expensive. Using axial clearance grooves creates a distortion pattern on the flow path that is aerodynamically undesirable.

Various attempts have been made to overcome these limitations of the prior art. U.S. Pat. No. 5,328,327 discloses a method of installing a set of vanes that does not use any of the prior described methods but that does require threaded members 72 to hold the vanes into the housing ring. These threaded members require a complex installation method and because the vanes are designed to pivot, the threaded members pose a risk of becoming loose.

As can be seen, there is a need for an improved variable geometry vane and vane installation method. There is a need for variable geometry vanes that can be easily installed in turbine engines without the need for a split ring housing or specialized machining techniques. There is a need for a variable geometry vane that can be installed and retained without the use of threaded fasteners that can become loose.

SUMMARY OF THE INVENTION

An improved stator variable geometry vane comprises a vane with a necked down portion. The vane can slide radially to allow the single piece shroud containing the vanes to be positioned for installation. Once in position a clip cooperates with the necked down portion of the vane to hold it in place.

In one aspect of the present invention, the method of installing a stator vane set using the improved vane comprises the steps of first installing a plurality of vanes into the shroud in mating holes; this step advantageously occurs outside the engine. The second step is to push the vanes as far out as they will go radially relative to the shroud.

In another aspect of the invention, slots in the shroud can be used to provide installation clearance for the blade of the vane. These small slots allow the vanes to be manually pushed to a radial position beyond what would otherwise be possible to provide maximum radial clearance during installation of the vane and shroud assembly. Vane to shroud assembly can occur outside the engine with all the vanes still at their outermost radial position. The vane buttons will clear the hub and hover over the button holes provided in the hub as the vane and shroud assembly is placed in position. The fourth step is to push the vanes radially inward and then to install a clip onto each vane to hold it in place. Finally an adjacent part traps all the clips in place, giving the advantage that no clips can slip out of position.

In another aspect of the invention variable geometry vanes have a first radial outermost position in radially oriented holes in a single piece shroud such that the shroud and vanes once assembled can be placed into a turbine engine, eliminating the need for a split ring shroud. The variable geometry vanes have a second radial innermost position relative to the shroud where they can be locked using slidable clips.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Figure 1:
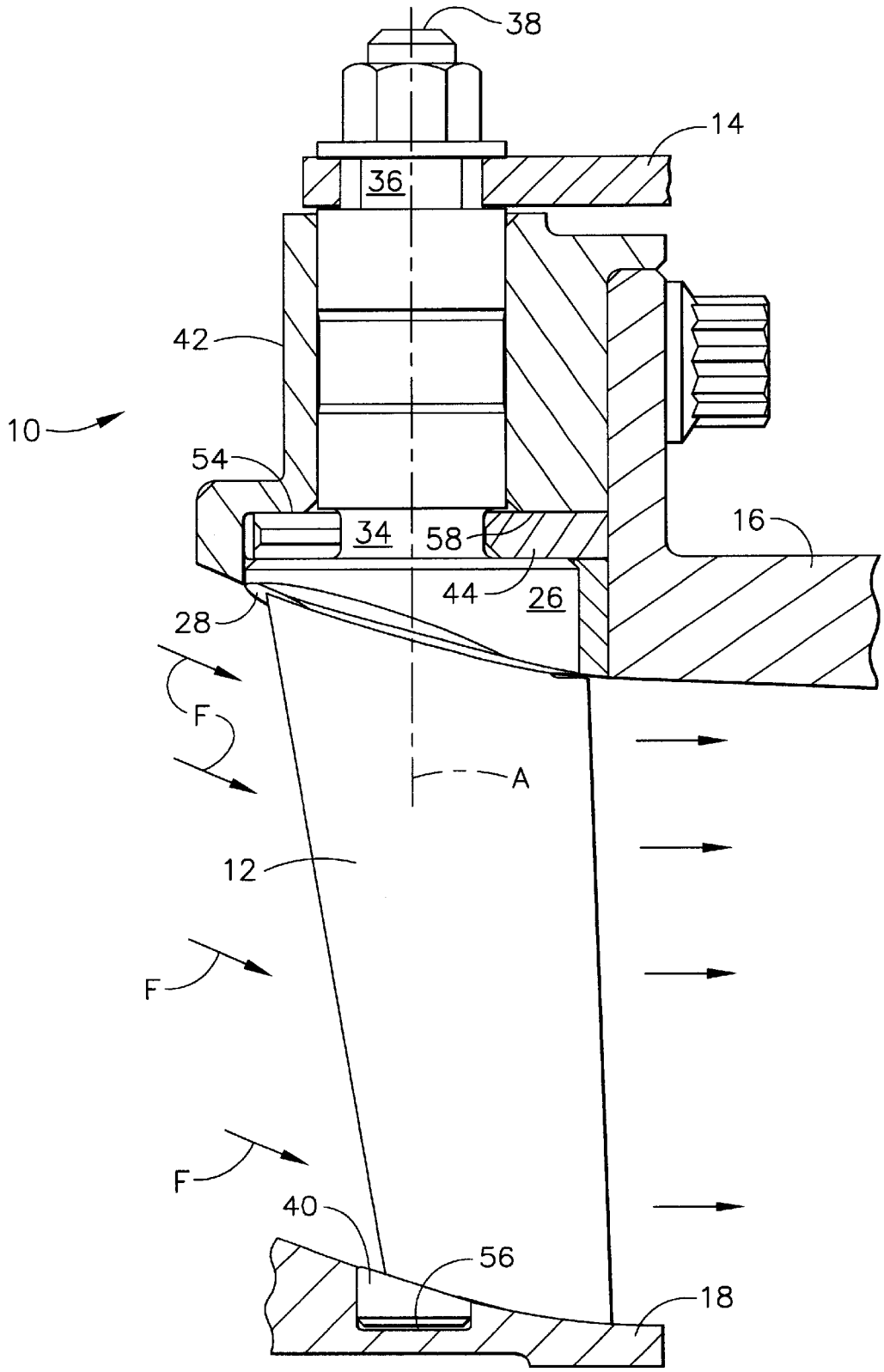
FIG. 1 is a partial cross sectional view of a portion of a turbine engine stator assembly using the vane radial mounting apparatus in accordance with an embodiment of the present invention.

FIG. 1 shows a partial cross section of a portion of a turbine engine such as might be used in a commercial airliner and other applications. The stator assembly 10 uses an improved variable geometry vane 12 that, unlike the prior art, does not include threaded connectors that can become loose. The variable geometry vane 12 is shown in the intake air stream indicated by arrows 'F'. The turbine engine stator assembly 10 may include a linkage arm 14 that controls the angle of attack of the variable geometry vane 12 and thus the intake air stream indicated by arrows 'F' through the stator assembly 10. It will be understood that while only one vane 12 is shown, a plurality of vanes 12 would be included in the stator assembly. The vane 12 can be mounted to the fixed shroud 42 of the engine at one end and to the hub 18 at the button 40. While the shroud 42 and hub 18 are fixed, the vane 12 can pivot about its long axis 'A' and the pivot can be controlled by the linkage arm 14. Only a portion of the adjacent part 16 is shown for clarity, in FIGS. 1 and 5.

Figure 2:
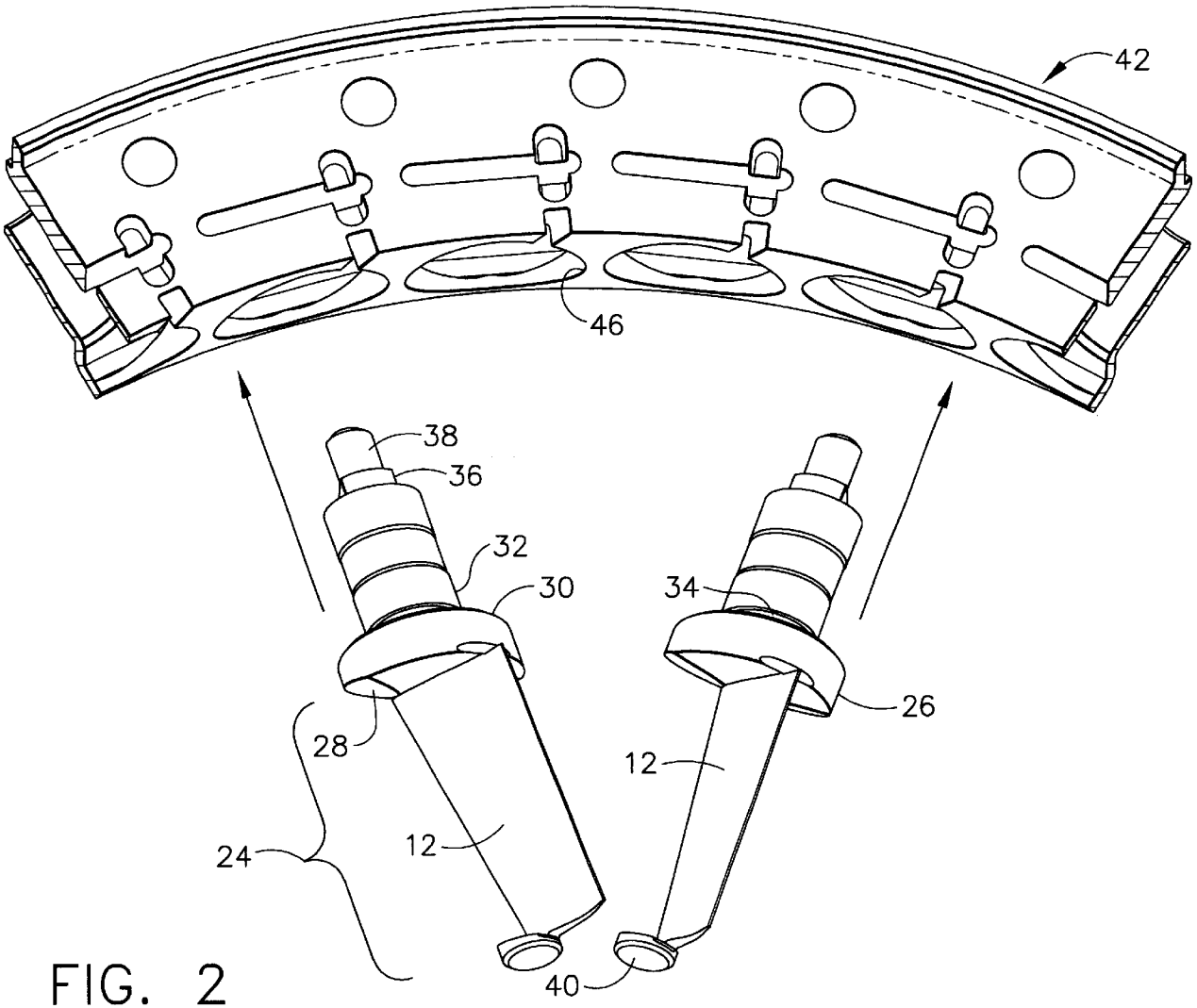
FIG. 2 shows a perspective view of details of the vane and shroud unassembled in accordance with an embodiment of the present invention.

FIG. 2 shows details of the vane 12 and a partial section of ring shaped shroud 42 which are shown in an unassembled state as they would be prior to installation in the engine. The arrows indicate the direction that the vanes 12 would move to become assembled with the shroud 42. The vanes 12 each include a relatively long thin air foil section 24 that can direct air flow. The vanes 12 may include a shroud button portion 26 (that includes a tapered portion 28) that can mate up to the shroud 42 as seen in FIG. 1 and can blend with a surface of shroud 42 to minimize disruption of air flow. The shroud button 26 may also include a shoulder portion 30. The cylindrical shaft portion 32 may slip into mating holes 46 in the shroud 42. There can be a necked down portion 34 between the shaft portion 32 and the shoulder 30. The arm connection lug 36 is the portion that may connect the control arm 14 to the vane 12, as seen in FIG. 1, and can allow for controlled rotation of the vane 12 about its long axis 'A', shown in FIG. 1. Extension 38 may extend above the shaft 32 to allow retention of the arm 14. Finally, there can be a hub button 40 at the radial base of the vane 12.

Figure 3:
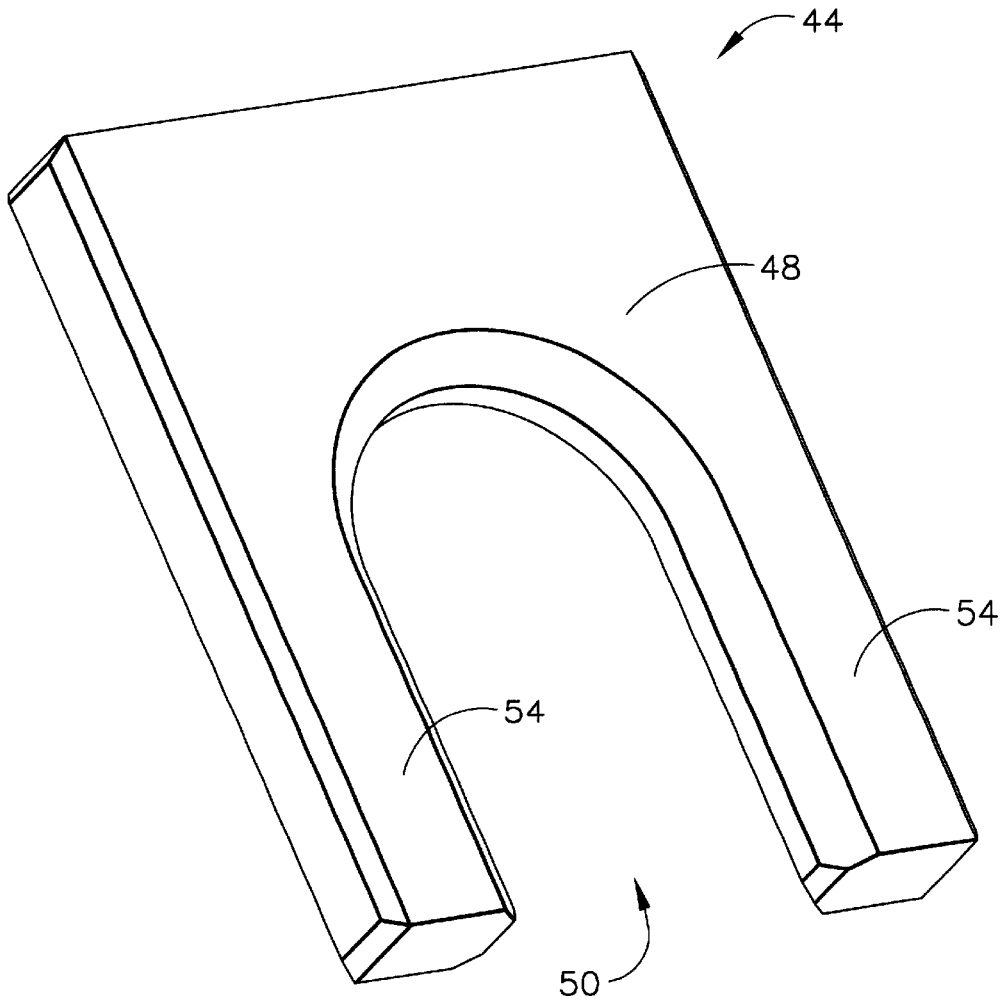
FIG. 3 shows a perspective view of the clip in accordance with an embodiment of the present invention.

FIG. 3 shows details of a clip 44, which can include a flat section 48 and a pocket 50 formed by two arm extensions 54. The flat section 48 may provide a wear surface for each of the vanes 12 to ride on when they rotate. The pocket 50 can be just large enough to hold the neck down portion 34 of the vane 12. The other side of flat surface 48 may rest against shoulder 30 and part of the shroud 42.

Figure 4:
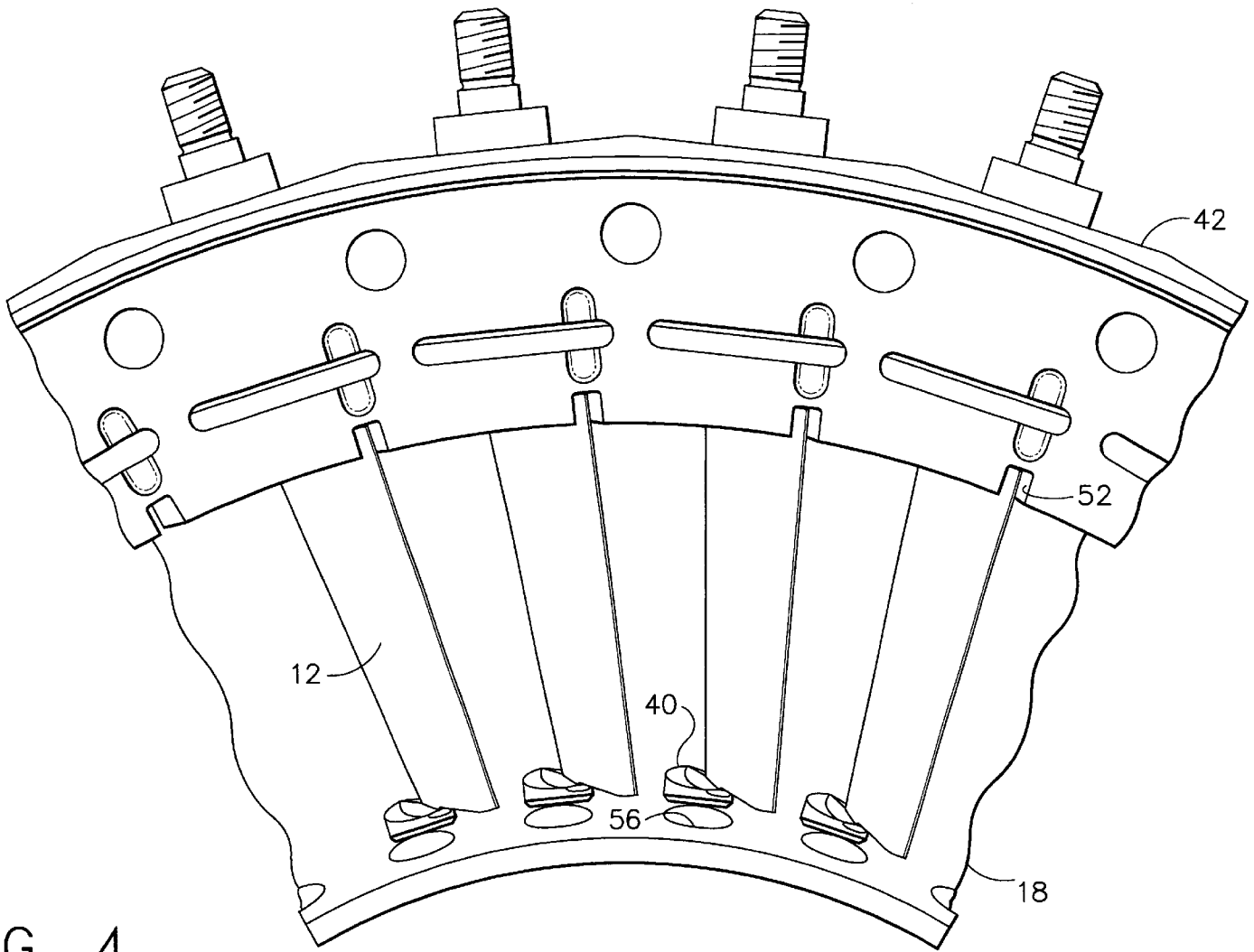
FIG. 4 shows an end view of an intermediate step of assembling the stator into a turbine engine in accordance with an embodiment of the present invention.

Referring now to FIG. 4, the vanes 12 and shroud 42 set above the engine hub 18 are ready for assembly to the hub section 18. The hub buttons 40 are positioned above the hub 18 and the holes 56 in the hub 18, with the vanes 12 being in their outermost radial position. Thin radial slots 52 in the shroud 42 may allow the airfoil portion 24 of the vane 12 to slide into the shroud 42. Without these radial slots 52, the vane 12 may not extend radially far enough for the hub button 40 to clear the hub 18 during assembly. Axial slots 58 in the shroud 42 can provide a space for the clip 44 to slide in to capture the vane 12 and lock it in place once the vanes 12 are in their radial innermost position as shown in FIG. 5.

Figure 5:
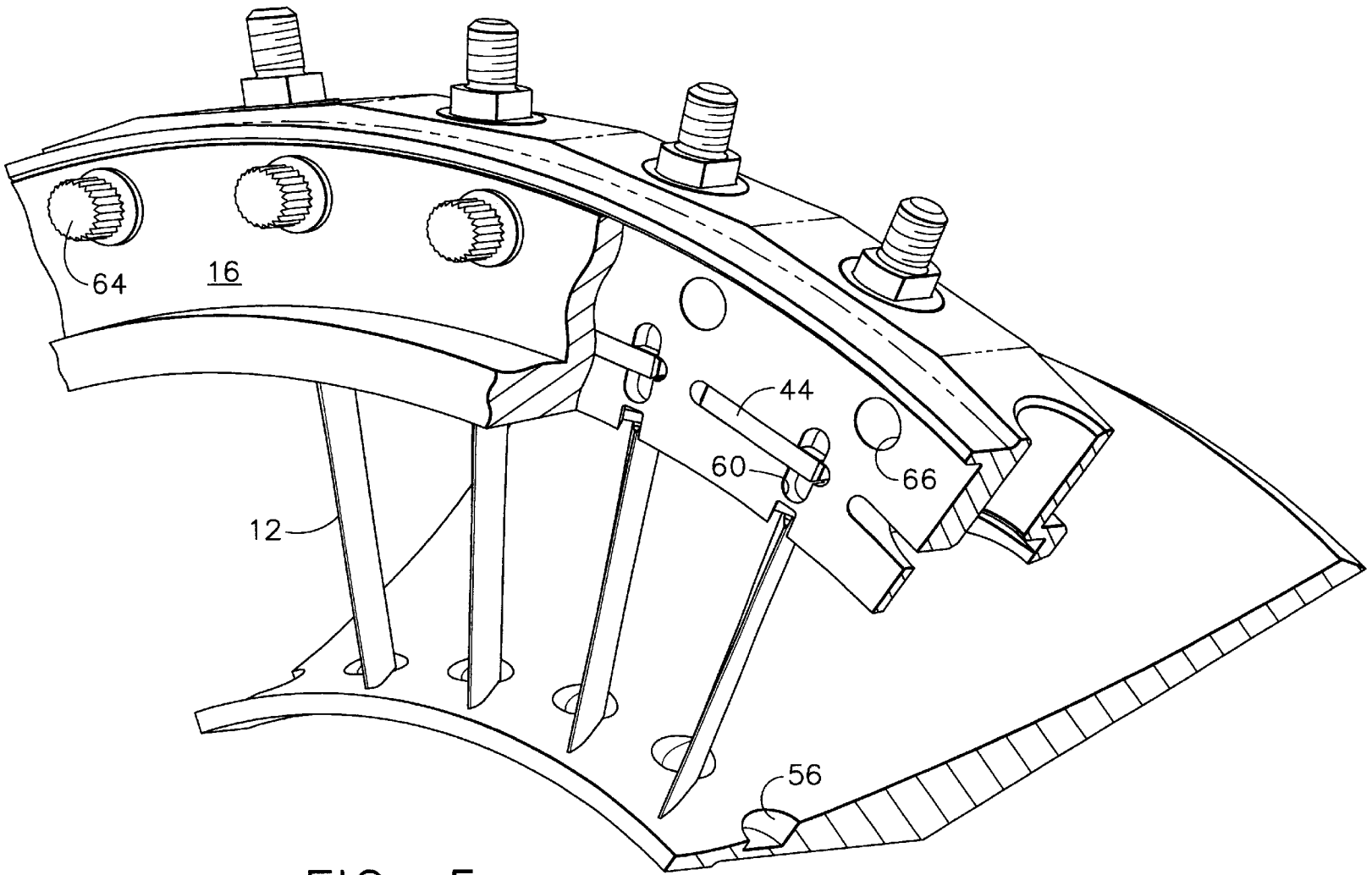
FIG. 5 is a perspective view of the assembled vane apparatus in accordance with an embodiment of the present invention.

FIG. 5 shows that the vanes 12 have been pushed down into the hub holes 56. This arrangement can provide adequate structural support against harmonic vibration set up by airflow over the relatively long thin airfoil 24 portion of the vane 12. The clips 44 can be slid into the slots 58 and around the necked down portion 34 (see FIG. 2) of the vane 12 to hold the vane 12 against radial movement relative to the shroud 42 and hub 18. Indentions 60 on either side of the slot 58 can allow the tips of a pair of needle nose pliers (not shown) to grasp the end of the clip 44 to remove it when required. Once the clips 44 are in place, an adjacent part 16 (partially shown) may be attached using bolts 64 to the shroud 42 using holes 66, thus retaining the clips 44 in place.

Referring to FIGS. 1, 2, 4 and 5, disassembly of the assembly begins with FIG. 1 and the removal of the linkage arm 14, and then disassembly occurs in the reverse order as assembly. Referring to FIG. 5, bolts 64 are removed from holes 66, and adjacent part 16 is removed from the shroud 42. Then, needle nose pliers (not shown) can be used to remove each clip 44 from each slot 58. As the clips 44 are removed, the vanes 12 are free to slide to their outermost radial position as shown in FIG. 4. Slots 52 allow the vanes 12 to travel far enough radially so that the hub buttons 40 clear the hub 18. Vanes 12 can be moved radially by hand. Once all the vanes 12 clear the hub 18, the shroud 42 and vane 12 assembly can be removed from around the hub 18. Then, the vanes 12 can be removed from the shroud 42 as shown in FIG. 1.

The vane 12 is shown as secured by a two-legged clip 44. The vane 12 could also be secured by a variety of other shapes of clips or non-threaded fasteners such as pins without departing from the scope of the invention.

It should be understood, of course, that the foregoing relates to preferred embodiments of the invention and that modifications may be made without departing from the spirit and scope of the invention as set forth in the following claims.

We claim:

1. A variable geometry vane and shroud ring for use in a turbine engine comprising;

at least one vane rotatably held within radial oriented holes in said shroud;

said vane having a first radial outer position within said radial oriented holes in said shroud;

said vane having a second radial inner position;

said vane including an airfoil section;

said shroud comprising a single-piece ring disposed radially outward from said airfoil section; and said shroud including a slidable clip engaging a portion of said vane to hold said vane in said second position.

2. The variable geometry vane and shroud ring of claim 1, wherein said shroud includes a removable adjacent part to retain said clip.

3. The variable geometry vane and shroud ring of claim 1, wherein said shroud includes a face with a slot therein and wherein at least one of said clips slides into said slot to engage said portion of said vane.

4. A variable geometry vane and shroud ring for use in a turbine engine, comprising:

at least one vane slidably and rotatably held within radial oriented holes in said shroud;

said vane having a first radial outer position within said radial oriented holes in said shroud;

said vane having a second radial inner position; and said shroud including a slidable clip engaging a portion of said vane to hold said vane against sliding in a radial direction, holding said vane in said second position, wherein said shroud includes a face with an axial slot therein and wherein at least one of said clips slides into said axial slot to engage said portion of said vane, and wherein said face further includes indentions adjacent to said axial slot to aid in the removal of said vane.

5. The variable geometry vane and shroud ring of claim 4, wherein removal of the clip allows said vane to be slid from said second position to said first position.

6. The variable geometry vane and shroud ring of claim 5, wherein said vane includes an airfoil section, and said shroud ring includes a plurality of radial slots wherein each of said radial slots is adapted for receiving a portion of said airfoil section when said vane is moved from said second position to said first position.

7. The variable geometry vane and shroud ring of claim 6, wherein said vane includes a shroud button radially outwardly from and adjacent to said airfoil section.

8. The variable geometry vane and shroud ring of claim 4, wherein said clip comprises a non-threaded fastener.

9. A variable geometry vane assembly directing flow of air in a turbine engine, said variable geometry vane assembly comprising;

a shroud adjacent an exterior portion of said engine;

a hub centrally located in said engine;

at least one vane slidably and rotatably held within radial oriented holes in said shroud;

said vane having an axis and said vane rotatable about said axis;

said vane including a necked down portion contained within said radial oriented holes in said shroud;

a slidable clip in an axial slot through said shroud, said clip engaging a portion of said necked down portion to hold said vane against sliding in the radial direction; and an adjacent part attached to said shroud to prevent sliding of said clip, wherein said shroud includes at least one indention adjacent said clip to facilitate removal of said clip to release said vane for radial movement.

10. The variable geometry vane assembly of claim 9, wherein said shroud includes at least one radial slot near a radial inner edge thereof, said at least one radial slot providing clearance for an airfoil portion of said vane when said vane is slid to a radial outermost position.

11. The variable geometry vane assembly of claim 9, wherein said vane includes an airfoil section including a hub button on a radially innermost portion of said airfoil section, and wherein said hub button fits into a hole in said hub when said vane is slid to a radial innermost position.

12. The variable geometry vane assembly of claim 9, wherein said shroud forms a ring surrounding said hub and an airfoil section of said at least one vane.

13. The variable geometry vane assembly of claim 9, wherein said vane includes a shoulder adjacent to said necked down portion such that said shoulder rests against said clip.

14. A variable geometry vane assembly directing the flow of air in a turbine engine, said variable geometry vane assembly comprising;

a shroud ring adjacent an exterior portion of said engine;

a hub centrally located in said engine;

at least one vane slidably and rotatably held within radial oriented holes in said shroud ring;

said vane having a first radial outer position within said radial oriented holes in said shroud ring;

said vane having a second radial inner position adjacent said hub; and a slidable clip engaging a portion of said vane to hold said vane against sliding in the radial direction to hold said vane in said second position, wherein said clip is located in an axial slot passing through a face on said shroud ring, wherein said face on said shroud ring includes indentions adjacent to said axial slot to facilitate removal of said clip.

15. The variable geometry vane assembly of claim 14, wherein an adjacent part attached to said shroud ring prevents sliding of said slidable clip.

16. The variable geometry vane assembly of claim 14, wherein said vane comprises a necked down portion disposed within said shroud ring, and said clip comprises a flat section, a pair of arm extensions, and a pocket disposed between said pair of arm extensions, said pocket sized to hold said necked down portion.

17. The variable geometry vane assembly of claim 16, wherein said vane includes an airfoil section disposed radially inward from said necked down portion, and wherein a portion of said airfoil section is contained within a radial slot when said vane is in said first position.

18. The variable geometry vane assembly of claim 17, wherein said shroud ring surrounds said hub.

19. The variable geometry vane assembly of claim 14, wherein the vane includes a hub button and wherein said hub button fits into a hole in said hub when said vane is in said second position.

20. The variable geometry vane assembly of claim 14, wherein said vane includes a shroud button radially outwardly from and adjacent to an airfoil and wherein said shroud button blends with a surface of said shroud ring.

21. A variable geometry vane assembly directing the flow of air in a turbine engine, said variable geometry vane assembly comprising;

a shroud adjacent an exterior portion of said engine, said shroud having an axial face and a plurality of axial slots within said axial face of said shroud;

a hub centrally located in said engine;

a plurality of vanes slidably and rotatably held within radial oriented holes in said shroud;

said vanes each having an axis and each of said vanes adapted for controlled rotation about said axis;

said vanes each including a necked down portion contained within said radial oriented holes in said shroud;

a plurality of slidable clips in said axial slots through said shroud, said clips engaging said necked down portion to hold each said vane against sliding in the radial direction;

a retention member attached to said shroud to prevent sliding of said clips; and said shroud including indentions adjacent to each said axial slot to facilitate removal of said clips.

22. A turbine engine comprising:

a variable geometry vane assembly directing flow of air in said turbine engine, said variable geometry vane assembly comprising;

a single-piece shroud ring adjacent an exterior portion of said engine;

a hub centrally located in said engine;

at least one vane rotatably held within radial oriented holes in said shroud ring, said vane including an airfoil section;

said vane having a first radial outer position within said radial oriented holes in said shroud;

said vane having a second radial inner position adjacent said hub; and a slidable clip engaging a portion of said vane to prevent said vane sliding in the radial direction and to hold said vane in said second position, wherein said shroud ring includes a plurality of radial slots, each of said radial slots adapted for radially receiving a portion of said airfoil section when said vane is moved from said second position to said first position.

23. The turbine engine of claim 22, wherein:

said vane includes a hub button disposed radially inward from said airfoil section; and said hub includes a plurality of hub holes, each of said hub holes adapted for receiving said hub button.

24. A method of assembling a variable geometry vane stator for use in a turbine engine having a shroud ring including the steps of:

radially outwardly sliding a plurality of vanes into a single-piece shroud ring having a plurality of spaced radial holes to receive said vanes to form a vane assembly;

further radially outwardly sliding at least one of said plurality of vanes until an airfoil portion of said vane is received in a radial slot on a radially inner portion of said shroud ring;

positioning said vane assembly so that it encircles a hub having a plurality of hub holes;

sliding each of said plurality of vanes radially inwardly until a portion of each vane is received in one of said plurality of hub holes in said hub; and sliding a clip into each of a plurality of axial slots in an axial face of said shroud ring, thereby radially retaining each of said plurality of vanes between said shroud ring and said hub.

25. The method of claim 24, further comprising attaching an adjacent part to said shroud ring to retain said clips in said axial slots.

26. The method of claim 24, wherein each of said plurality of vanes is rotatably held between said shroud ring and said hub.

27. An assembly, comprising:

a single-piece shroud having a plurality of radially oriented holes and a corresponding plurality of radial slots;

a hub disposed radially inward from said shroud, said hub having a plurality of hub holes; and a plurality of vanes rotatably retained between said shroud and said hub, each of said vanes having a vane axis, wherein:

each of said vanes comprises a shaft portion disposed within said shroud, a shroud button radially inward from said shaft portion, an airfoil section radially inward from said shroud button, and a hub button radially inward from said airfoil section, each of said radial slots is adapted for radially receiving a portion of said airfoil section when said vane is moved from a radial inner position to a radial outer position, and each of said hub holes is adapted for radially receiving said hub button when each of said vanes is moved from said radial outer position to said radial inner position.

28. The assembly of claim 27, further comprising:

a plurality of clips adapted for radially retaining said plurality of vanes, and each of said clips further adapted for allowing controlled rotation of each of said vanes about said vane axis.

29. The assembly of claim 28, wherein said shroud includes an axial face and a plurality of axial slots in said axial face, each of said axial slots adapted for receiving one of said clips.

30. The assembly of claim 28, wherein said shroud further includes at least one indention within said axial face, and said at least one indention is disposed adjacent each of said axial slots.

31. The assembly of claim 28, wherein said shroud further includes a pair of indentions, said pair of indentions disposed adjacent each other and on opposing sides of each of said axial slots.

32. The assembly of claim 30, wherein said at least one indention is adapted for removal of said clip from said axial slot.

33. The assembly of claim 31, wherein said pair of indentions are adapted for receiving a pair of needle-nose pliers for removal of each of said clips.

34. The assembly of claim 28, wherein each of said clips comprises a non-threaded fastener.

35. The assembly of claim 28, wherein each of said clips includes a flat section, a pair of arm extensions, and a pocket disposed between said pair of arm extensions.

36. The assembly of claim 34, wherein each of said clips is planar, said pair of arm extensions are parallel to each other, and said pocket is U-shaped.

37. The assembly of claim 35, wherein each of said vanes further comprises a necked down portion disposed between said shaft portion and said shroud button, and wherein said pocket is sized to receive said necked down portion.

38. The assembly of claim 35, wherein said clip and said vane are adapted such that said vane rides on said flat section when said vane rotates about said vane axis.

39. A method of assembling a variable geometry vane stator for use in a turbine engine, comprising:

a) providing an annular single-piece shroud and a hub, said shroud having a plurality of axial slots and a corresponding plurality of radial slots, and said hub having a corresponding plurality of hub holes;

b) providing a plurality of vanes, each of said vanes having a shaft portion, an airfoil section disposed radially inward from said shaft portion, and a hub button disposed radially inward from said airfoil section;

c) sliding said shaft portion of each of said plurality of vanes radially outwardly into said shroud, thereby providing a vane assembly, wherein a portion of said airfoil section is received within each of said radial slots;

d) positioning said vane assembly around said hub;

e) sliding each of said plurality of vanes radially inwardly such that each of said hub buttons is received within a corresponding one of said hub holes; and f) sliding a clip into each of said axial slots thereby radially retaining each of said plurality of vanes between said shroud and said hub, wherein each of said vanes has a vane axis and each of said vanes is adapted for controlled rotation about said vane axis.

40. The method of claim 39, wherein said axial slots are circumferentially arranged on an axial face of said shroud, and the method further comprises:

g) affixing an adjacent part to said axial face, thereby retaining said clip within said shroud.

41. The method of claim 40, wherein each of said vanes further comprises a necked down portion disposed between said shaft portion and said airfoil section, each of said clips includes a flat section, a pair of arm extensions, and a U-shaped pocket disposed between said pair of arm extensions, and wherein said step f) comprises sliding said clip such that said necked down portion is retained within said pocket.

* * * * *